United States Patent [19]

Goller et al.

[11] Patent Number: 4,592,214

[45] Date of Patent: Jun. 3, 1986

[54] FABRIC DRAW-OFF ROLLER ON FLAT-BED KNITTING MACHINES

[75] Inventors: Ernst Goller, Reutlingen; Günther Kazmaier, St. Johann-Ohnastetten, both of Fed. Rep. of Germany

[73] Assignee: H. Stoll GmbH & Co., Fed. Rep. of Germany

[21] Appl. No.: 645,136

[22] Filed: Aug. 28, 1984

[30] Foreign Application Priority Data

Aug. 29, 1983 [DE] Fed. Rep. of Germany ..... 3331052

[51] Int. Cl.[4] ..... D04B 15/88

[52] U.S. Cl. ..... 66/149 R; 66/150; 66/152

[58] Field of Search ..... 66/149 R, 150, 152

[56] References Cited

U.S. PATENT DOCUMENTS

| | | | |
|---|---|---|---|
| 2,959,041 | 11/1960 | Scheller et al. | 66/150 |
| 3,050,972 | 8/1962 | Noe | 66/152 |
| 3,625,028 | 12/1971 | Challenger et al. | 66/149 R |
| 3,956,907 | 5/1976 | Murphy et al. | 66/149 R |
| 4,478,058 | 10/1984 | Kazmaier et al. | 66/149 R |
| 4,481,795 | 11/1984 | Goller | 66/150 |

*Primary Examiner*—Ronald Feldbaum
*Assistant Examiner*—Mary A. Ellis
*Attorney, Agent, or Firm*—Jones, Tullar & Cooper

[57] ABSTRACT

A fabric draw-off roller (11) is described for flat-bed knitting machines equipped with individual roller elements (14, 14') situated side-by-side in line on a shaft (12), the rollers being allowed to turn relative to each other, but preferably restricted in their amount of angular movement. In order to ensure, with fabric draw-off rollers (11) of this type, that loose threads of the knitted fabric are prevented from entangling and jamming between neighboring roller elements (14, 14') when drawing off fabric from the machine, the individual roller elements (14, 14') are arranged at an axial distance from each other thereby forming a gap (54, 54') distance spacer (32, 32') is provided having a smaller external diameter than the maximum diameter of the roller element with at least one of its ends overlapping and penetrating an axial bore of an adjacent roller element (14, 14'). As a result, a circular gap (53, 53') between the external circumference of the distance spacer (32, 32') and the internal circumference of the roller element bore is formed, accessible from the axial gap (54, 54').

7 Claims, 3 Drawing Figures

FABRIC DRAW-OFF ROLLER ON FLAT-BED KNITTING MACHINES

TECHNICAL FIELD

The present invention relates to a fabric draw-off roller, in particular for flat-bed knitting machines having individual roller, elements held side by side on a shaft which turn relative to each other to a given extent.

BACKGROUND OF THE INVENTION

With draw-off rollers used to date for the knitted fabric on flat-bed knitting machines, the individual roller elements are arranged side by side in line on the shaft, such that they lie with their end-faces immediately against each other. Due to the unavoidable play of the roller elements lying against each other, loose threads of the knitting can be drawn off and become entangled as well as jammed between neighboring roller elements. This has a disadvantageous effect upon the draw-off of the knitted fabric and can also lead to damage of the fabric. Frequently, one has to resort to providing tearing devices for such threads in the region of the draw-off roller elements. This means however, an increased cost in design and assembly.

SUMMARY OF THE INVENTION

It is the task of the present invention to create a fabric draw-off roller of the aforementioned type which prevents loose threads of knitted fabric from becoming entangled between neighboring roller elements and jamming when being drawn off. This task is resolved for a fabric draw-off roller of the mentioned type by arranging the individual roller elements of the roller at an axial distance from each other and by providing them with spacers having a smaller external diameter. The spacer penetrates an axial bore of a neighboring, roller element thereby defining a circular gap accessible by an axial gap also formed by the spacer relative to the neighboring roller element.

Since not only an axial slot exists between the roller elements lying side by side, but an associated radial slot as well, both of which feature an air gap and, which in each case, are appreciably greater than the anticipated thickness of the loose threads, provision is thus made for preventing loose threads or parts of threads of the fabric from becoming entangled or even jammed between neighboring roller elements when drawn off. The drawing off of fabric is therefore considerably improved, and, moreover, it prevents the knitting machine from having to be periodically stopped as a result of defective fabric draw-off. In addition, the task of cleaning away the threads, which until now had to be carried out from time to time, is no longer necessary.

With draw-off rollers previously used, the external circumferential surface was, for example, provided with a knurling, formed on a sleeve, which is fitted over a roller core. In the past, this sleeve was manufactured from seamless rubber and then pushed over the roller core which was made from a die casting or similar, thus preventing a gap from being formed. However, it is relatively difficult to achieve the push over, which has the result of producing an irregular effect, causing the knurling to become distorted. In addition, the rubber sleeves are cut shorter in length than the roller core by approximately 1 mm at both ends of the respective roller elements, in order to counteract the variations in tolerance. Consequently, a very narrow gap with extremely sharp edges is formed between the sleeves, which still tends to catch and pull in loose threads on the knitting. Moreover, the problem of entanglement and jams was merely transferred to the roller core. Besides, with increasing use over a period of time, on at least the edge between the sleeve and roller core, a certain radial gap forms, due to stress, so that this tends to cause tangles and the jamming of loose threads as well. In order to prevent this tangling and jamming of loose threads from the fabric, the sleeve is provided, according to a further arrangement of the present invention, with an outer chamfer at both ends and forms an axial gap with the sleeve of a neighboring roller element of the same width as that between the roller cores. Furthermore, it is preferable that the sleeve be made from plastic, better still, from polyurethane. The roller core, also of plastic, preferably of polyamide, is injected in the sleeve. As a result, the bond between the roller core and the sleeve is made in a more simple manner and, in particular, is more accurate. At the same time, and without more, it is possible to keep the sleeve circumferentially and axially fixed to the roller core.

For proper support, on the largest part of the roller elements used as a draw-off roller, the spacer sleeve, formed in one piece integral with the roller element, only overlaps the neighboring roller element with one of its ends. As a separate component, the spacer sleeve is merely provided to additionally support the shaft of the draw-off roller at one or several points to prevent deflection and is held stationary to the machine frame on its external circumference with its internal circumference supporting the draw-off shaft via a roller bearing.

Further details and configurations of the present invention are given in the following description, in which the present invention with the aid of the preferred embodiment depicted in the drawing is explained and described more fully.

DESCRIPTION OF A PREFERRED EMBODIMENT

Figure 1:
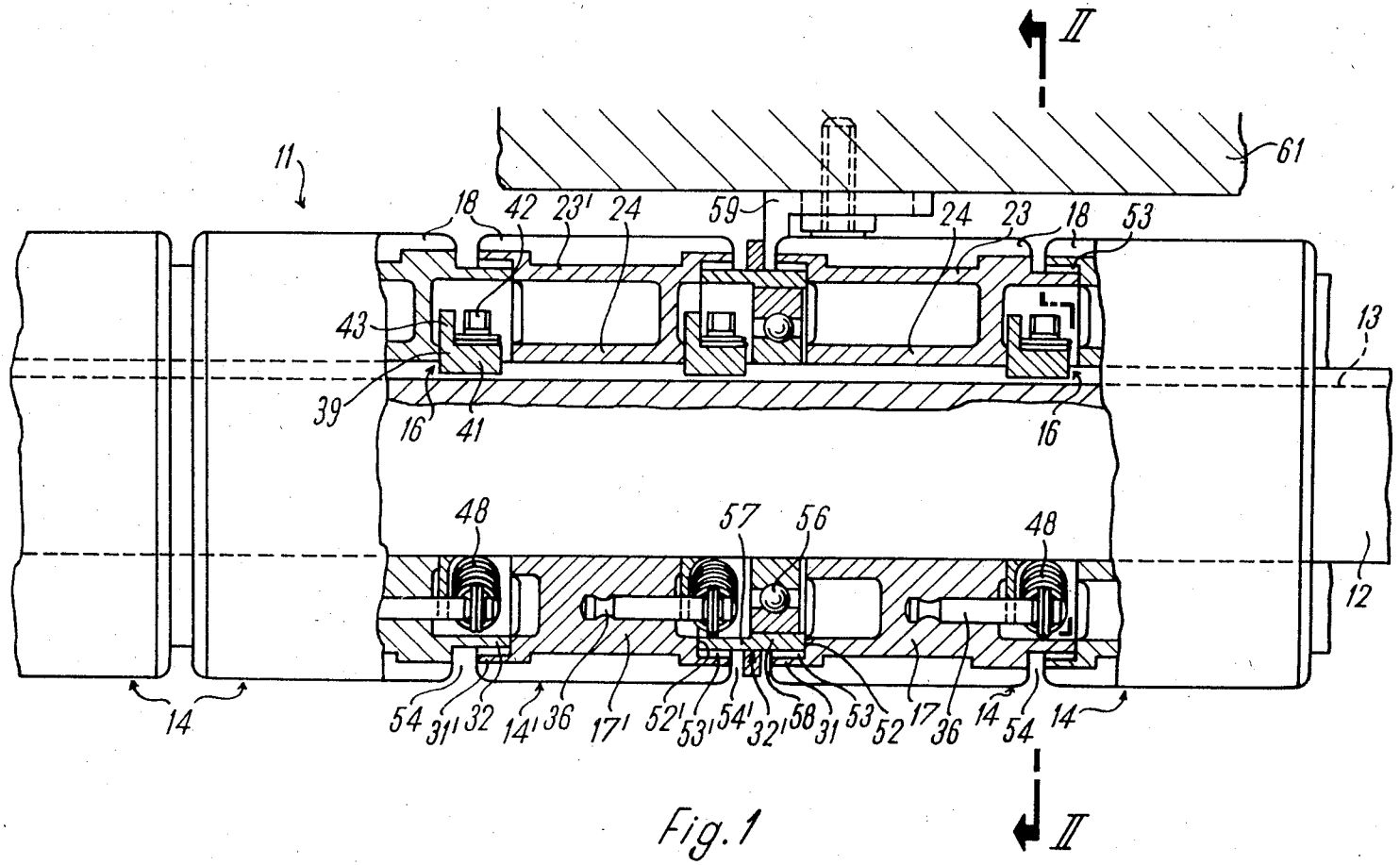
FIG. 1 is a partially sectioned side view the center region of a fabric draw-off roller in accordance with a preferred embodiment of the present invention.

A fabric draw-off roller 11, is used to draw off knitted fabric 19 from a flat-bed knitting machine. The draw-off roller 11 has a through shaft 12, which is, although not depicted, free to rotate at both ends in bearings in the machine frame, and which, for instance, can be driven via a chain and sprocket in the diection of the fabric draw-off. On the shaft 12, which is provided with a through axial keyway 13, are a number of roller elements 14 arranged side by side and intermeshed in line. A non-rotating thrust ring 16, fixed to the shaft 12, is fitted next to a roller element 14. The individual roller elements 14 can pivot through a predetermined angle relative to the thrust ring 16, and, therefore, relative to each other on the shaft 12.

Figure 3:
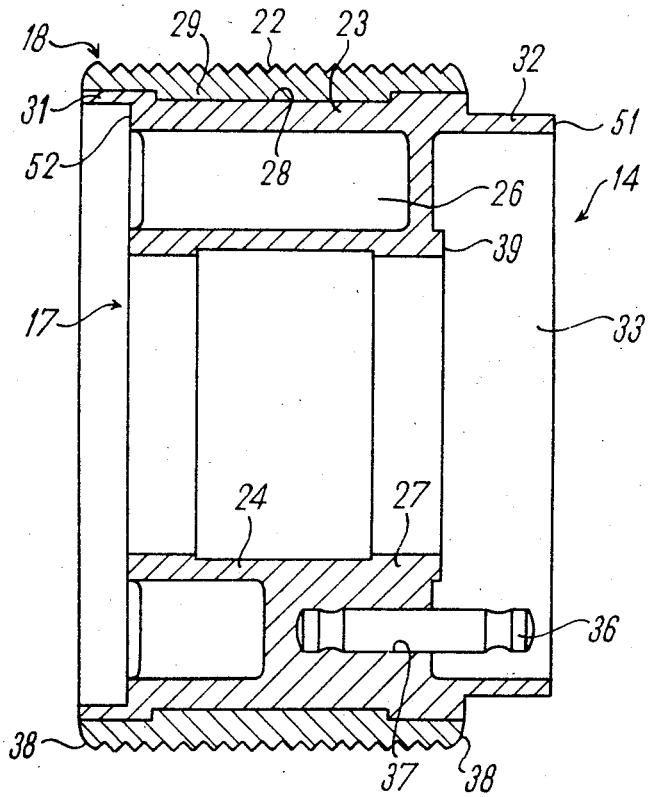
FIG. 3 is an enlarged view in longitudinal section of the roller elements used for the draw-off roller of FIG. 1.

FIG. 3 shows a roller element 14 in detail. The roller element 14 has a roller core 17, which is manufactured from polyamide, on which a roller covering in the form of a sleeve 18 is retained. The sleeve 18 is prevented from twisting and is fixed axially on the roller core 17. The external circumferential surface of the sleeve 18 is formed by a transverse sequence of knurling 22. The roller core 17 comprises an outer casing 23 and a concentrically positioned inner casing 24, which is set back at both ends in relationship to the end-faces of the outer casing 23. The inner and outer casings are linked integrally together via an intermediate base and/or webs 26 spaced at an angular distance to each other, and also via a boss 27 to a point on the circumference of the outer casing 23. The outer casing 23 has an annular relief 28 in the centre of its external circumference for axial location of an internal annular projection 29 on the sleeve 18. The internal diameter of the outer casing 23 is enlarged by a relief at the end zone 31, which is opposite the linking elements 26 and 27 of both casings 23 and 24, and which projects beyond the respective end of the inner casing 24.

At the other end of the roller core 17 the outer casing 23 is provided with a formed distance spacer 32, whose external circumference is set back so that the outer diameter of the spacer 32 is smaller than the internal diameter of the opposite end 31 of the outer casing 23. An anchor and stop pin 36 projects into the space 33 within the spacer 32, and is retained in the boss 27 by, for example, a precision fit and/or snap interlock. In an arrangement not shown, the pin 36 is formed from the same material as the roller core 17 as an integral part during manufacture.

The sleeve 18 extends over the entire length of the outer casing 23 (omitting the distance spacer 32) and is equipped, for example, at its ends with rounded off chamfers 38. The roller element 14 is manufactured in such a manner that the sleeve 18 is formed initially from polyurethane, during which the knurling 22, the chamfers 38 and the annular projection 29 are formed at the same time. The roller core 17 is subsequently injected by using a form into the sleeve 18, during which polyamide is used.

Figure 2:
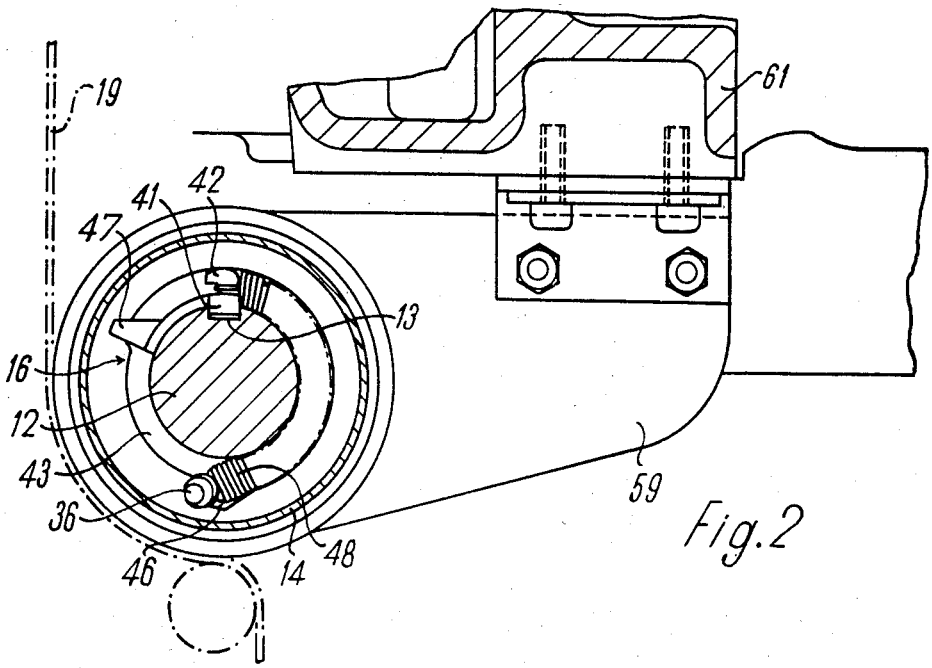
FIG. 2 is a section along the line II—II of FIG. 1 to a reduced scale.

If the roller elements 14 are aligned on the shaft 12, then between each two roller elements 14 a thrust ring is pushed, which finds space in the spaced 33 within the distance spacer 32. Whilst the roller elements 14 are arranged on the shaft 12 to rotate without an appreciable radial play, a key 41 of the thrust rings 16 sits in the axial keyway 13 of the shaft 12, so that the thrust rings 16 are prevented from turning on the shaft 12. As FIGS. 1 and 2 show, the thrust ring 16 lies with its side-face on the annular end-face 39 of the inner casing 24. The thrust ring 16 is basically a disc 43 on which the key 41 is formed or fixed opposite the inner casing 24. At the same time, the key is provided with a hook 42 on its end opposite to the shaft 12. The disc 43 of the thrust ring 16 has an upper and lower thrust nib 46, 47, which lie apart at a certain angle of, for instance, 100° and which work in conjunction with the anchor and stop pin 36 of the roller element in question. Between the hook 42 of the thrust ring 16 and the anchor and stop pin 36 of the roller element 14 is a tension spring 48 lying over a part of the external circumference of the shaft 12, tensioned such that the pin 36 of the roller element 14 is drawn in the direction of rotation, that is, the direction of rotation of the knitted fabric draw-off, towards the lower thrust nib 46. This means that the roller element 14 can pivot during rotation of the shaft 12 against the direction of the fabric draw-off 19 under the influence of the spring 48 through a predetermined angle relative to the shaft 12, and continue until the anchor and stop pin 36 comes to rest on the upper thrust nib 47. The roller element 14 can again return by the force of the spring 48 when it is in the zone opposite the point of fabric contact.

On aligning the roller elements 14 on the shaft 12, the annular end-face 51 of the distance spacer 32 comes to rest on the annular end-face 52 of the outer casing 23, whereupon the distance spacer 32 projects into the end zone 31. In this way, two neighboring roller elements 14 overlap each other and form a circular gap 53 due to the aforementioned differences in diameter. This circular gap 53 is appreciably greater than the thickness of threads used on flat-bed knitting machines. The spacer 32 is longer than the end zone 31 is deep, and is extended to form an axial gap 54 between the outer casing 23 and/or the sleeves 18 of neighboring roller elements 14, which once again is greater than the threads are thick and which is, for example, wider than the circular gap 53. By this arrangement the axial gap 54 and the circular gap 53 are interconnected. This arrangement prevents loose threads of the knitted fabric 19 from becoming entangled or jammed between neighboring roller elements 14.

FIG. 1 shows a relatively long draw-off roller 11, and shaft 12. It is necessary to support the shaft 12 at at least one point near its center to a fixed point on the machine, apart from supporting its ends, in order to prevent deflection of the shaft 12. To do this, a roller element 14' has identical ends, i.e., it has no spacer 32. Instead, a separate spacer 32' is provided between the roller elements 14' and 14, whose zone facing the roller element 14 enables the shaft to rotate via a roller bearing 56. The separate spacer 32' lies with its end 58 against the roller bearing 56 as the formed spacer 32 on the annular end-face 52 of the outer casing 23 of the neighboring roller element 14. The other end 57 of the separate distance spacer 32' supports itself on an end-face 52' of the outer casing 23' of the roller element 14', whose annular end-face 52' is also formed at this end of the outer casing 23' as a result of an enlarged internal diameter. Basically, this is to ensure that a circular gap 53, and 53' respectively is formed between the external circumference of both ends 57, 58 of the separate spacer 32' and the internal circumference of the end zone 31 of the neighboring roller element 14 on the one hand, and on the other hand, between the internal circumference of the end 31' of the outer casing 23' of the roller element 14'.

The length of the separate distance spacer 32' is determined such that an axial gap 54' exists between the neighboring roller elements 14 and 14', which is somewhat wider than the axial gap 54. An angle bracket 59 in this gap 54' projects into a region opposite the fabric contact zone with the draw-off roller 11, and is connected with the separate spacer 32' at one end, leaving a gap on each side between the roller elements 14 and 14' respectively, and connected at the other end to a rigid and stationary part 61.

What is claimed is:

1. A fabric draw-off roller, in particular for flat-bed knitting machines, comprising:

a shaft; and a plurality of roller elements mounted in side-by-side relationship on the shaft, each roller element being mounted to turn relative to each other a predetermined amount, wherein:

(i) at least two adjacent roller elements of said plurality of roller elements each has: a casing having an outer surface and an axial bore at one end of the casing, which defines an inner surface of the casing and an annular end face; and an axially extending distance spacer at the other end of the casing having an annular end face and an outer surface with a diameter less than the diameter of the inner surface defined by said bore to produce a circular gap between the outer surface of the spacer and the inner surface of the axial bore of an adjacent roller element;

(ii) the axial length of the distance spacer being greater than the axial length of said bore with the annular end face of the distance spacer abutting the annular end face of the bore of an adjacent roller element to produce an axially extending gap between the outer surfaces of adjacent casings outer surfaces; and (iii) the axial gap communicating with the circular gap.

2. The fabric draw-off roller as defined in claim 1, wherein:

(iv) the distance spacer is formed integrally with said casing.

3. The fabric draw-off roller as defined in claim 1, further comprising:

a separate spacer which penetrates the axial bore of two adjacent roller elements to define thereby an adjacent circular gap with each.

4. The fabric draw-off roller as defined in claim 3, further comprising:

a roller bearing arranged between the shaft and the separate spacer, and wherein:

(iv) the separate spacer is held stationary.

5. The fabric draw-off roller as defined in claim 1, further comprising:

a sleeve for each roller element, each sleeve having an outer knurled surface, further wherein:

(iv) each roller element has a casing;

(v) each sleeve being fixed over a respective casing and stationary relative thereto;

(vi) each sleeve is provided with an outer chamfer at both ends; and (vii) each sleeve and casing form axial gaps of equal width with the sleeve and casing, respectively, of an adjacent roller element.

6. The fabric draw-off roller as defined in claim 5, further wherein:

(viii) each casing forms part of a core of its respective roller element;

(ix) the sleeve of each roller element comprises plastic, preferably polyurethane;

(x) the core of each roller element comprises plastic, preferably polyamide; and (xi) each core is injected into its respective sleeve.

7. The fabric draw-off roller as defined in claim 6, wherein each roller element further has:

an axial pin, and further wherein:

(xii) the axial pin of each roller element lies within the distance spacer.

* * * * *